US006058675A

United States Patent [19]

MacDonald

[11] Patent Number: 6,058,675

[45] Date of Patent: May 9, 2000

[54] ANGULARLY ORIENTABLE POST

[76] Inventor: Donald Rodney MacDonald, Box 3012, Stony Plain, Alberta, Canada, T7Z 1V7

[21] Appl. No.: 09/195,810

[22] Filed: Nov. 19, 1998

[51] Int. Cl.[7] ..... E04C 3/30

[52] U.S. Cl. ..... 52/736.1

[58] Field of Search ..... 52/127.7, 296, 52/736.1; 248/188; 404/9

[56] References Cited

U.S. PATENT DOCUMENTS

| | | | |
|---|---|---|---|
| 1,746,672 | 2/1930 | Nylund et al. | 52/296 X |
| 2,103,410 | 12/1937 | Frei, Jr. | 52/296 X |
| 2,141,067 | 12/1938 | Miller | 52/736.1 X |
| 2,945,659 | 7/1960 | McDonald | 52/296 |
| 3,349,531 | 10/1967 | Watson | 52/296 |
| 4,588,324 | 5/1986 | Goellner | 404/9 X |
| 4,807,838 | 2/1989 | Anderson | 248/188 X |

*Primary Examiner*—Christopher T. Kent
*Assistant Examiner*—Brian E. Glessner
*Attorney, Agent, or Firm*—Davis and Bujold

[57] ABSTRACT

An angularly orientable post includes a base and a rigid support extending substantially vertically from the base. The support has a first end secured to the base and a second end. A positioning member is supported by the support and positioned in proximity to the second end of the support. The positioning member is laterally movable relative to the support. A tubular shell is provided which is adapted to telescopically overlie the support and positioning member. The angular orientation of the tubular shell relative to the base is determined by the lateral positioning of the positioning member. The positioning member is locked in a selected lateral position which provides the desired angular orientation.

10 Claims, 5 Drawing Sheets

ANGULARLY ORIENTABLE POST

FIELD OF THE INVENTION

The present invention relates to an angularly orientable post.

BACKGROUND OF THE INVENTION

A post is usually secured perpendicularly to the surface upon which it rests. When the surface upon which the post rests is sloped, however, this it is frequently not desirable to have the post extending perpendicularly to the surface. In such cases, the angular orientation of the post relative to the surface is altered to a substantially vertical orientation. This alteration in angular orientation is usually accomplished using shims positioned at a base of the post.

SUMMARY OF THE INVENTION

What is required is a post that can be more readily adjusted to an angular orientation that best suits a particular application.

According to the present invention there is provided an angularly orientable post which includes a base and a rigid support extending substantially vertically from the base. The support has a first end secured to the base and a second end. A positioning member is supported by the support and positioned in proximity to the second end of the support. The positioning member is laterally movable relative to the support. A tubular shell is provided which is adapted to telescopically overlie the support and positioning member. The angular orientation of the tubular shell relative to the base is determined by the lateral positioning of the positioning member. Means is provided for locking the positioning member in a selected lateral position.

With the angularly orientable post, as described above, the tubular shell portion of the post can be adjusted to a desired angular orientation relative to the base and then positioning member locked in the angular position selected.

There are a variety of ways in which the teachings of the present invention may be put into practise. It is preferred that the positioning member be donut shaped, with a central aperture that is larger than that portion of the support with which it is engaged. This enables limited lateral movement of the positioning member relative to the support. It is also preferred that the positioning member be clamped in a selected lateral position by some form of clamping arrangement.

Although beneficial results may be obtained through the use of the angularly orientable post, as described above, there is a danger that the tubular shell may be subsequently knocked and telescopically separated from the support and the positioning member. Even more beneficial results may, therefore, be obtained when the positioning member is expandable to engage the tubular shell.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
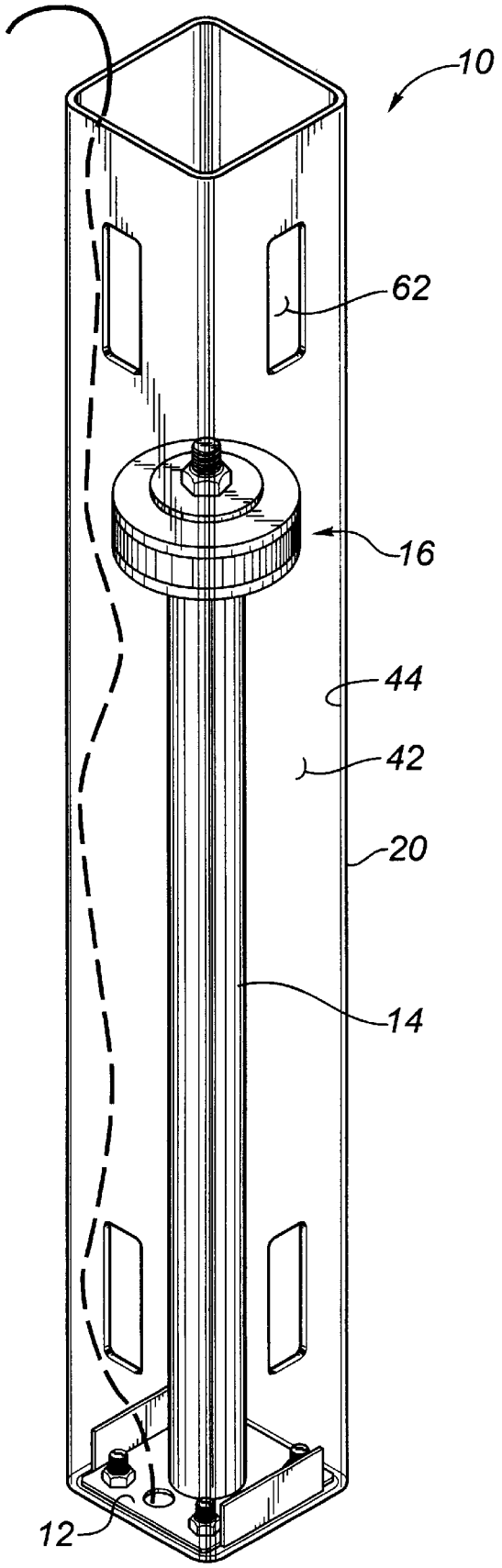
FIG. 1 is a partially cut away perspective view of an angularly orientable post constructed in accordance with the teachings of the present invention.

The preferred embodiment, an angularly orientable post generally identified by reference numeral 10, will now be described with reference to FIGS. 1 through 8.

Figure 2:
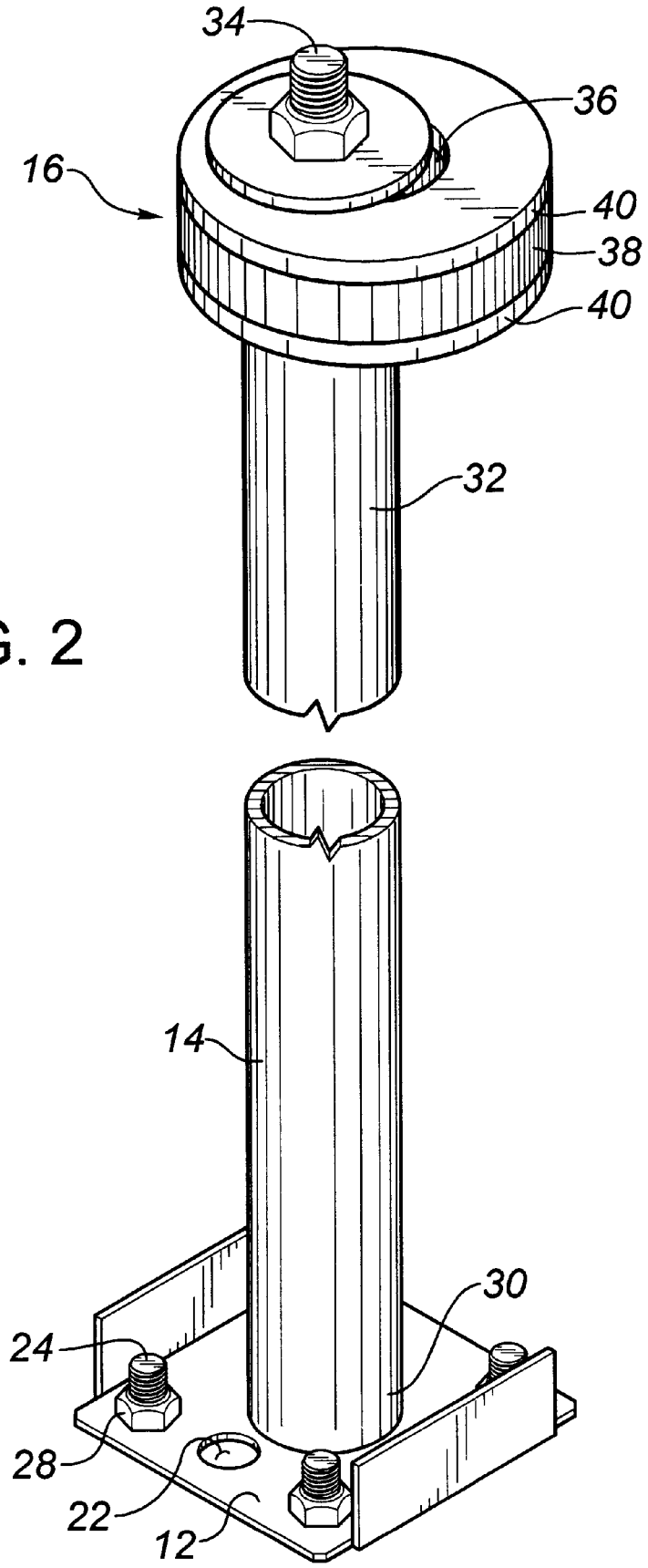
FIG. 2 is a perspective view of base, rigid support and positioning member portions of the angularly orientable post illustrated in FIG. 1.
Figure 4:
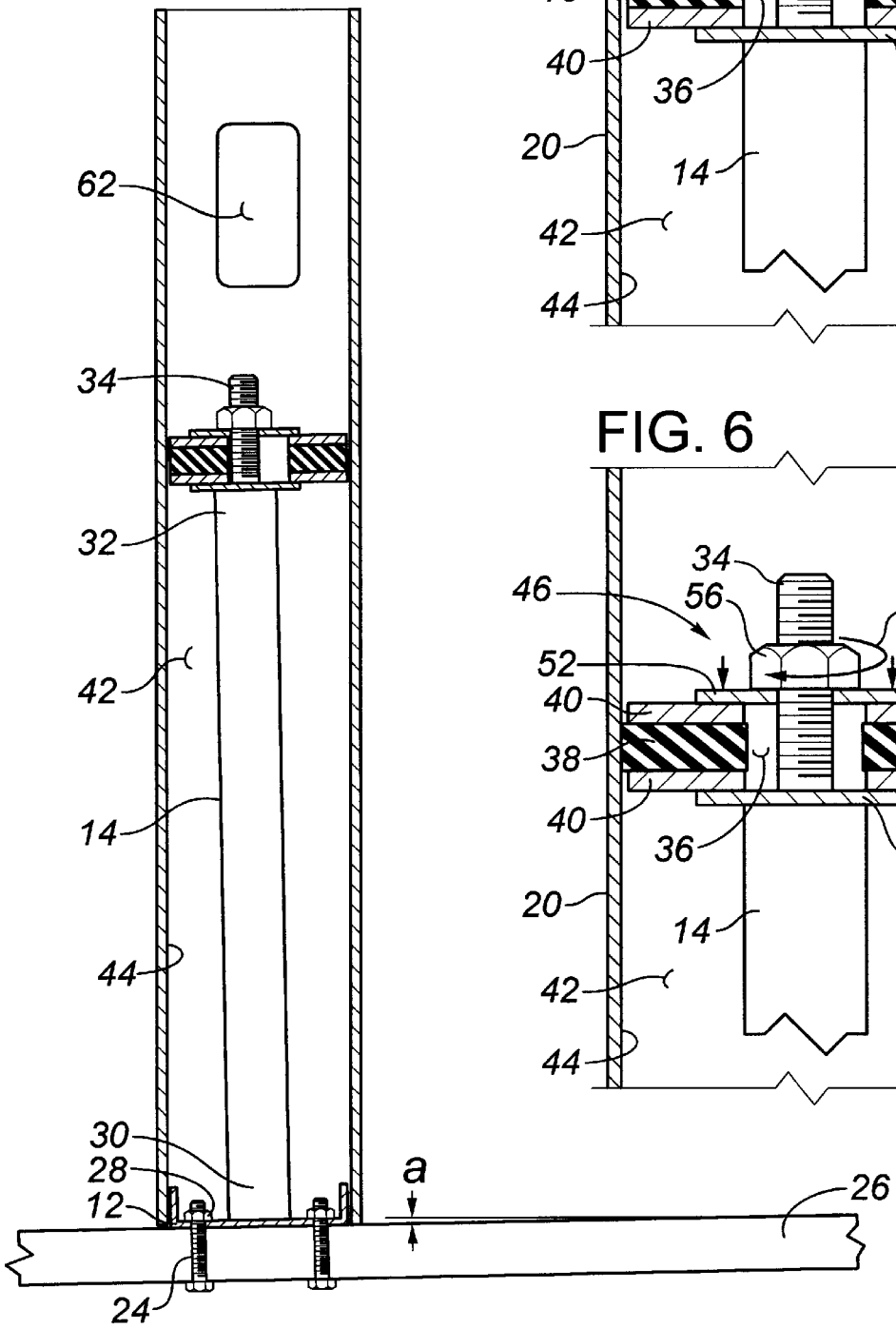
FIG. 4 is a side elevation view, in section, of the angularly orientable post illustrated in FIG. 1.
Figure 7:
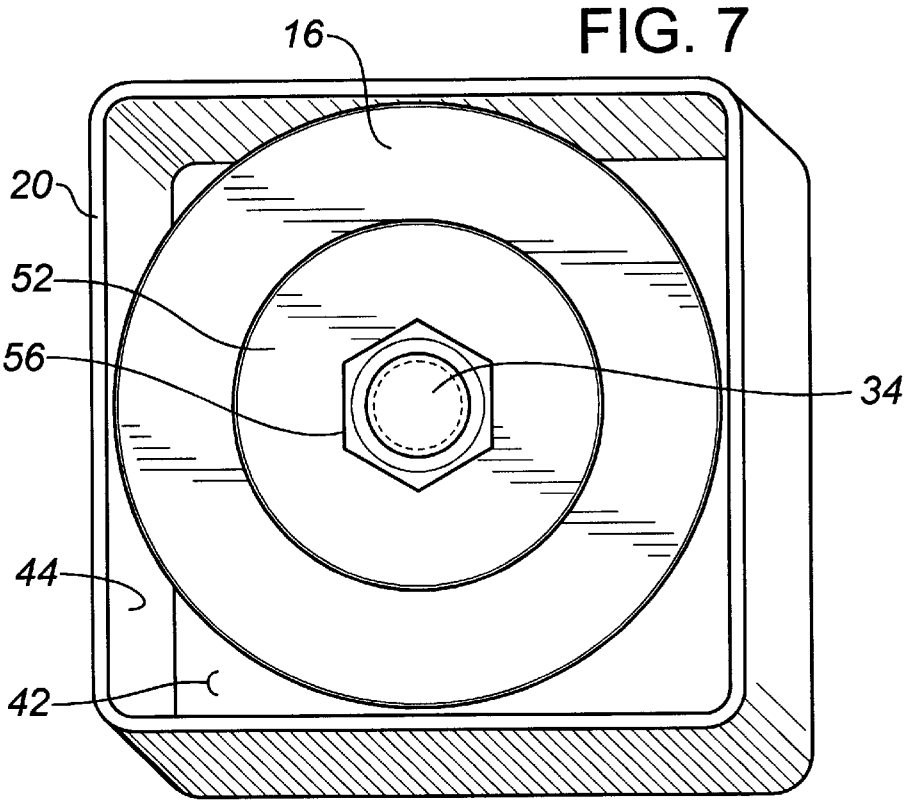
FIG. 7 is a detailed top plan view of the angularly orientable post illustrated in FIG. 1, with the positioning member in a substantially concentric position placing the tubular shell in a perpendicular angular orientation relative to the base.
Figure 8:
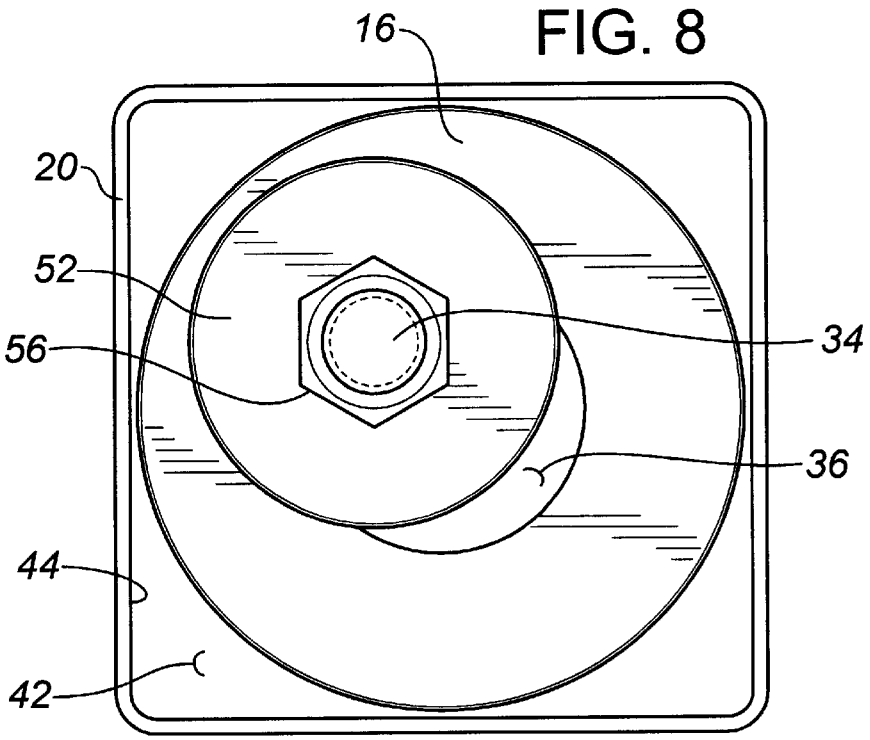
FIG. 8 is a detailed top plan view of the angularly orientable post illustrated in FIG. 1, with the positioning member in an eccentric position thereby placing the tubular shell in a non-perpendicular angular orientation relative to the base.

Referring to FIG. 1, angularly orientable post 10 includes a base 12, a rigid support 14, a positioning member 16 and a tubular shell 20. Referring to FIG. 2, the preferred form for base 12 is a plate with apertures 22 to receive bolts 24. Referring to FIG. 4, base 12 is secured to a surface 26 by means of bolts 24 used in conjunction with nuts 28. In many installations lag bolts are used for bolts 24. Referring to FIG. 2, support 14 extends substantially vertically from base 12. Support 14 has a first end 30 secured to base 12 and a second end 32 that terminates in an upstanding threaded rod 34. For lack of a better term, positioning member 16 can be considered to be "donut" shaped with a central aperture 36. For the purpose of this patent application the term "donut" must be understood to include shapes other than round. It will be understood that positioning member 16 can be square or other geometric shapes. Similarly, central aperture can be square or other geometric shapes. Positioning member 16 is placed onto support 14 with threaded rod 34 extending through central aperture 36. Central aperture 36 is larger than threaded rod 34. This enables limited lateral movement of positioning member 16 relative to support 14. As will hereinafter be described, positioning member 16 is expandable. There are a variety of ways in which a positioning member could be constructed to be expandable. Positioning member 16 includes a compressible member 38 sandwiched between two non-compressible members 40. Referring to FIGS. 1 and 4, tubular shell 20 has an interior bore 42 defined by sidewalls 44. Tubular shell 20 is adapted to telescopically overlie support 14 and positioning member 16. Referring to FIG. 4, the angular orientation of tubular shell 20 relative to base 12 is determined by the lateral positioning of positioning member 16. This angular difference is identified by the letter "a". The range of angular movement can be understood by a comparison of FIG. 7 and FIG. 8. In FIG. 7, positioning member 16 is in a substantially concentric position relative to support 14, which places tubular shell 20 is a substantially perpendicular orientation to base 12. In FIG. 8, positioning member 16 has been moved laterally relative to support 14, which places tubular shell 20 in an angularly offset orientation relative to base 12.

Figure 3:
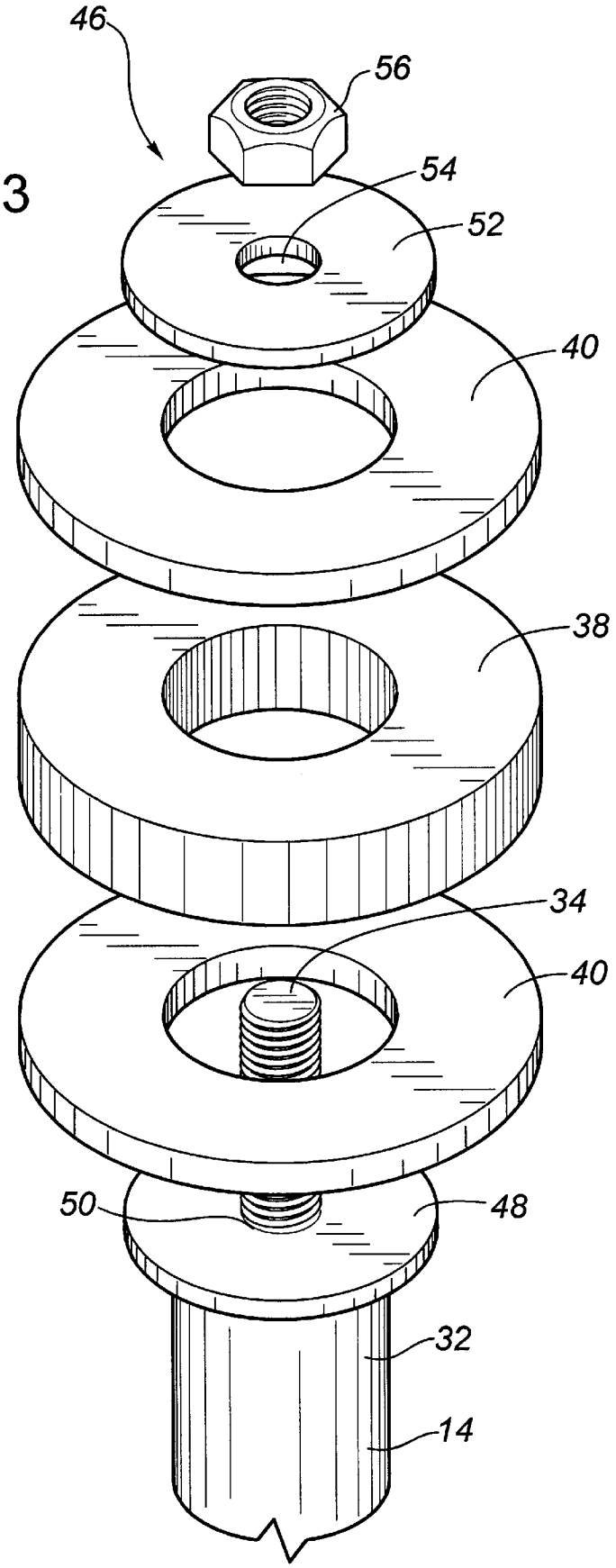
FIG. 3 is an exploded perspective view of a second end of a rigid support illustrated in FIG. 1.
Figure 5:
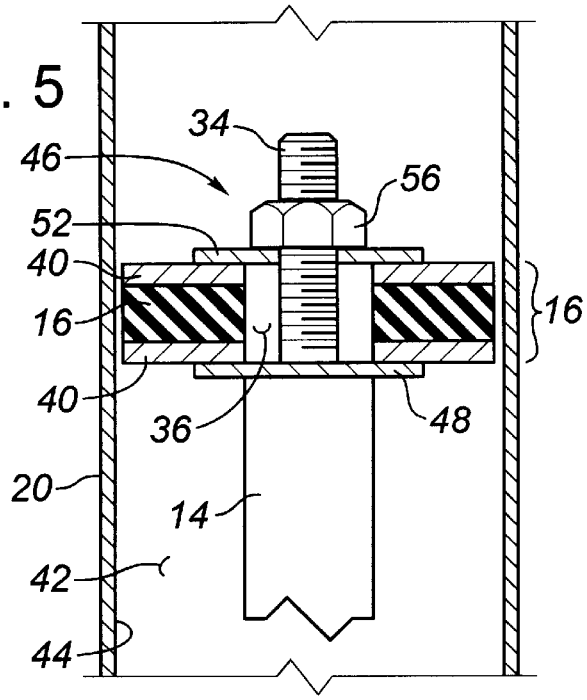
FIG. 5 is a detailed side elevation view, in section, of the angularly orientable post illustrated in FIG. 4, with the positioning member in a non-expanded condition.
Figure 6:
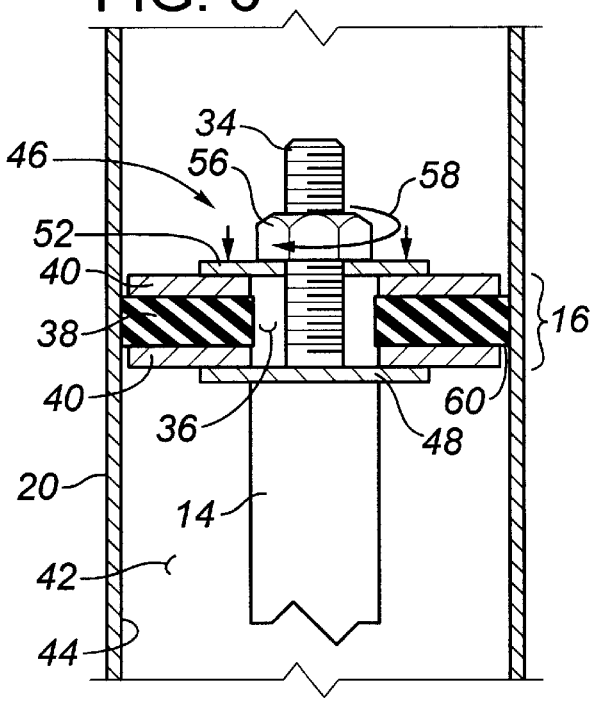
FIG. 6 is a detailed side elevation view, in section, of the angularly orientable post illustrated in FIG. 4, with the positioning member in an expanded condition.

As previously mentioned, the angle of offset has been identified on FIG. 4 by the letter "a". Referring to FIG. 3, a clamp, generally identified by reference numeral 46 is used for locking positioning member 16 in a selected lateral position. Clamp 46 includes a first clamping plate 48 with a first aperture 50 through which extends threaded rod 34 and a second clamping plate 52 with a second aperture 54 through which extends threaded rod 34. A nut 56 positioned on threaded rod 34 is used to urge second clamping plate 52 toward first clamping plate 48. Referring to FIG. 5, clamp 46 is illustrated in a position before pressure is applied to positioning member 16. Referring to FIG. 6, clamp 46 is illustrated with nut 56 being tightened as represented by arrow 58. It will be noted that a portion of compressible member 38, identified by reference numeral 60, is extruded outwardly from between non-compressible members 40 to engage sidewalls 44 of tubular shell 20. Referring to FIG. 1, where rails are to be extended between adjacent ones of posts 10, openings are provided through sidewalls 44 of tubular shell 20 to accommodate such rails (not shown). Depending upon the height of tubular shell 20, openings 62 may be used to permit the convenient insertion of a tool (not shown) into interior bore 42 for the purpose of tightening nut 56 on threaded rod 34. This enables one to avoid having to use an extension attachment on such tool, as would be the case when tightening nut 56 from above.

The use and operation of angularly orientable post 10, will now be described with reference to FIGS. 1 through 8. Referring to FIG. 4, base 12 is secured to surface 26 by means of bolts 24 used in conjunction with nuts 28. Tubular shell 20 is then telescopically slid down over positioning member 16 as illustrated in FIGS. 5 and 7. Tubular shell 20 is then positioned in a desired angular orientation as illustrated in FIG. 4. Referring to FIG. 6, clamp 46 is then used to secure positioning member 16 in position, by tightening nut 56 as represented by arrow 58. A point will be reached at which positioning member 16 is secured against movement relative to support 14. Upon further tightening of nut 56, portion 60 of compressible member 38 will be extruded outwardly from between non-compressible members 40 to engage sidewalls 44 of tubular shell 20. This prevents tubular shell 20 from being telescopically withdrawn from its position overlying support 14 and positioning member 16.

It will be apparent to one skilled in the art that modifications may be made to the illustrated embodiment without departing from the spirit and scope of the invention as hereinafter defined in the Claims.

The Embodiments of the invention in which an exclusive property or privilege is claimed are defined as follows:

1. An angularly orientable post, comprising:

a base;

a rigid support extending substantially vertically from the base, the support having a first end secured to the base and a second end;

a positioning member supported by the support and positioned in proximity to the second end of the support, the positioning member being laterally movable relative to the support;

a tubular shell telescopically overlying the support and positioning member, such that the angular orientation of the tubular shell relative to the base is determined by the lateral positioning of the positioning member;

means for locking the positioning member in a selected lateral position.

2. The angularly orientable post as defined in claim 1, wherein the positioning member is donut shaped, with a central aperture that is larger than that portion of the support with which it is engaged, thereby enabling limited lateral movement of the positioning member relative to the support.

3. The angularly orientable post as defined in claim 1, wherein the positioning member is expandable to engage the tubular shell.

4. The angularly orientable post as defined in claim 3, wherein the positioning member includes a compressible member sandwiched between two non-compressible members.

5. The angularly orientable post as defined in claim 1, wherein the means for locking the positioning member in a selected lateral position is a clamp.

6. The angularly orientable post as defined in claim 5, wherein the clamp includes a threaded rod on the support, a first clamping plate with a first aperture through which extends the threaded rod, a second clamping plate with a second aperture through which extends the threaded rod, a nut positioned on the threaded rod whereby one of the first clamping plate and second clamping plate is urged toward the other of the first clamping plate and the second clamping plate.

7. The angularly orientable post as defined in claim 6, wherein the tubular shell has an interior bore defined by sidewalls, the tubular shell having an opening through the sidewalls to permit insertion of a tool into the interior bore whereby the positioning of the nut on the threaded rod is adjusted.

8. An angularly orientable post, comprising:

a base;

a rigid support extending substantially vertically from the base, the support having a first end secured to the base and a second end with an upstanding threaded rod;

a donut shaped positioning member with a central aperture overlying the threaded rod of the support, the central aperture being larger than the threaded rod, thereby enabling limited lateral movement of the positioning member relative to the support;

a tubular shell having an interior bore defined by sidewalls, the tubular shell telescopically overlying the support and the positioning member, such that the angular orientation of the tubular shell relative to the base is determined by the lateral positioning of the positioning member, the interior bore being sized to accommodate the positioning member in friction fit relation;

a clamp for locking the positioning member in a selected lateral position, the clamp including a first clamping plate with a first aperture through which extends the threaded rod, a second clamping plate with a second aperture through which extends the threaded rod, and a nut positioned on the threaded rod whereby one of the first clamping plate and the second clamping plate is urged toward the other of the first clamping plate and the second clamping plate, thereby clamping the positioning member in a selected lateral position.

9. An angularly orientable post, comprising a base;

a rigid support extending substantially vertically from the base, the support having a first end secured to the base and a second end with an upstanding threaded rod;

a donut shaped positioning member with a central aperture overlying the threaded rod of the support, the central aperture being larger than the threaded rod, thereby enabling limited lateral movement of the positioning member relative to the support, the positioning member being expandable and including a compressible member sandwiched between two non-compressible members;

a tubular shell having an interior bore defined by sidewalls, the tubular shell telescopically overlying the support and the positioning member, such that the angular orientation of the tubular shell relative to the base is determined by the lateral positioning of the positioning member;

a clamp for locking the positioning member in a selected lateral position, the clamp including a first clamping plate with a first aperture through which extends the threaded rod, a second clamping plate with a second aperture through which extends the threaded rod, and a nut positioned on the threaded rod whereby one of the first clamping plate and the second clamping plate is urged toward the other of the first clamping plate and the second clamping plate, thereby clamping the positioning member in a selected lateral position and expanding the positioning member by extruding outwardly the compressible member to engage the sidewalls defining the interior bore of the tubular shell.

10. The angularly orientable post as defined in claim 9, wherein the tubular shell has an opening through the sidewalls to permit insertion of a tool into the interior bore whereby the positioning of the nut on the threaded rod is adjusted.

* * * * *